United States Patent [19]

Ishikawa et al.

[11] Patent Number: 5,003,751

[45] Date of Patent: Apr. 2, 1991

[54] PACKAGING SYSTEM

[75] Inventors: Akira Ishikawa; Kazumasa Harada, both of Shizuoka, Japan

[73] Assignee: Fuji Photo Film Co., Ltd., Kanagawa, Japan

[21] Appl. No.: 444,904

[22] Filed: Dec. 4, 1989

[30] Foreign Application Priority Data

Dec. 5, 1988 [JP] Japan ..... 63-307429

[51] Int. Cl.[5] ..... G65B 11/30

[52] U.S. Cl. ..... 53/215; 53/587

[58] Field of Search ..... 53/139.3, 211, 212, 53/214, 215, 216, 225, 234, 399, 587

[56] References Cited

U.S. PATENT DOCUMENTS

| | | | |
|---|---|---|---|
| 1,108,027 | 8/1914 | Thorschmidt | 53/215 |
| 1,875,567 | 9/1932 | Daniels | 53/215 X |
| 1,987,482 | 1/1935 | Mandell | 53/215 X |
| 2,821,347 | 1/1958 | Stephens | 53/215 X |
| 3,659,394 | 5/1972 | Hartleib et al. | 53/216 X |
| 4,229,925 | 10/1980 | Stirniman | 53/215 X |
| 4,519,180 | 5/1985 | Maure | 53/234 |
| 4,674,260 | 6/1987 | Rasmussen et al. | 53/216 X |

FOREIGN PATENT DOCUMENTS

| | | | |
|---|---|---|---|
| 805139 | 7/1949 | Fed. Rep. of Germany | 53/215 |
| 2609672 | 9/1976 | Fed. Rep. of Germany | 53/215 |
| 53-3698 | 5/1976 | Japan . | |

*Primary Examiner*—Robert L. Spruill
*Assistant Examiner*—Linda B. Johnson
*Attorney, Agent, or Firm*—Sughrue, Mion, Zinn, Macpeak & Seas

[57] ABSTRACT

A packaging system wraps a sheet material around an article supplied at an article supply station and discharges the article at a discharge station. The packaging system includes a turret which is intermittently rotated by 180°, a pair of body wrapping mechanisms which are provided on the turret at an interval of 180° so that they are alternately positioned at the article supply station and the article discharge station when the turret is stopped. Each of the body wrapping mechanisms wraps the sheet material around the body of the article while the body wrapping mechanism is rotated from the article supply station to the article discharge station. A sheet supply mechanism supplies the sheet material, while the turret is stopped, from outside to a predetermined position on the turret where the sheet material can be supplied to the body wrapping mechanism.

4 Claims, 2 Drawing Sheets

PACKAGING SYSTEM

BACKGROUND OF THE INVENTION

1. Field of the Invention

This invention relates to a packaging system which is provided with a body wrapping mechanism for wrapping a sheet material around the body of an article.

2. Description of the Prior Art

In order to package a cylindrical article, there has been used a packaging system with a body wrapping mechanism. In Japanese Pat. Publication No. 53(1978)-3698, there is disclosed a packaging system in which three body wrapping mechanisms (with an end folding mechanism) are mounted on a turret which is intermittently rotated 60° by 60°, and supply of articles to be packaged, belt wrapping, body wrapping, end folding, belt wrapping release and discharge of the article are performed at respective stations while the turret is stopped.

The packaging system is disadvantageous in that since the aforesaid operations are performed while the turret is stopped, the cycle of the intermittent rotation of the turret is governed by the time required for the body wrapping operation which requires a relatively long time, and accordingly, the tact time cannot be made shorter than a certain time. Further, in the system where the operations are performed at the respective stations while the turret is stopped, the number of stations cannot be smaller than a certain value, which limits miniaturization of the packaging system. For example, even if the article supply operation and the belt wrapping operation are performed at one station, and the belt wrapping release operation and the article discharge operation are performed at one station, there are required at least three stations.

SUMMARY OF THE INVENTION

In view of the foregoing observations and description, the primary object of the present invention is to provide a packaging system which can be small in size and can shorten the tact time.

The packaging system in accordance with the present invention is characterized in that the body wrapping operation is performed while the turret is being rotated. That is, in accordance with the present invention, there is provided a packaging system which wraps a sheet material around an article supplied at an article supply station and discharges the article at a discharge station, the packaging system comprising a turret which is intermittently rotated by 180°, a pair of body wrapping mechanisms which are provided on the turret at an interval of 180° so that they are alternately positioned at the article supply station and the article discharge station when the turret is stopped, each of the body wrapping mechanisms wrapping the sheet material around the body of the article while the body wrapping mechanism is rotated from the article supply station to the article discharge station, and a sheet supply mechanism which supplies the sheet material, while the turret is stopped, from outside to a predetermined position on the turret where the sheet material can be supplied to the body wrapping mechanism.

The turret may be intermittently rotated in one direction and the other alternately.

The body wrapping mechanism which wraps the sheet material around the body of the article while the body wrapping mechanism is rotated from the article supply station to the article discharge station need not be arranged to complete the body wrapping operation while the turret is rotated but may be arranged to perform a part of the body wrapping operation while the turret is stopped at the article supply station or the article discharge station. For example, when the time necessary for the body wrapping operation is longer than the time required to rotate the body wrapping mechanism from the article supply station to the article discharge station, the rotating speed of the turret may be lowered and the body wrapping operation may be completed while the turret is rotated. Otherwise, a part of the body wrapping operation may be performed while the body wrapping mechanism is stopped at one of the article supply station and the article discharge station which is more convenient.

DESCRIPTION OF THE PREFERRED EMBODIMENT

Figure 1:
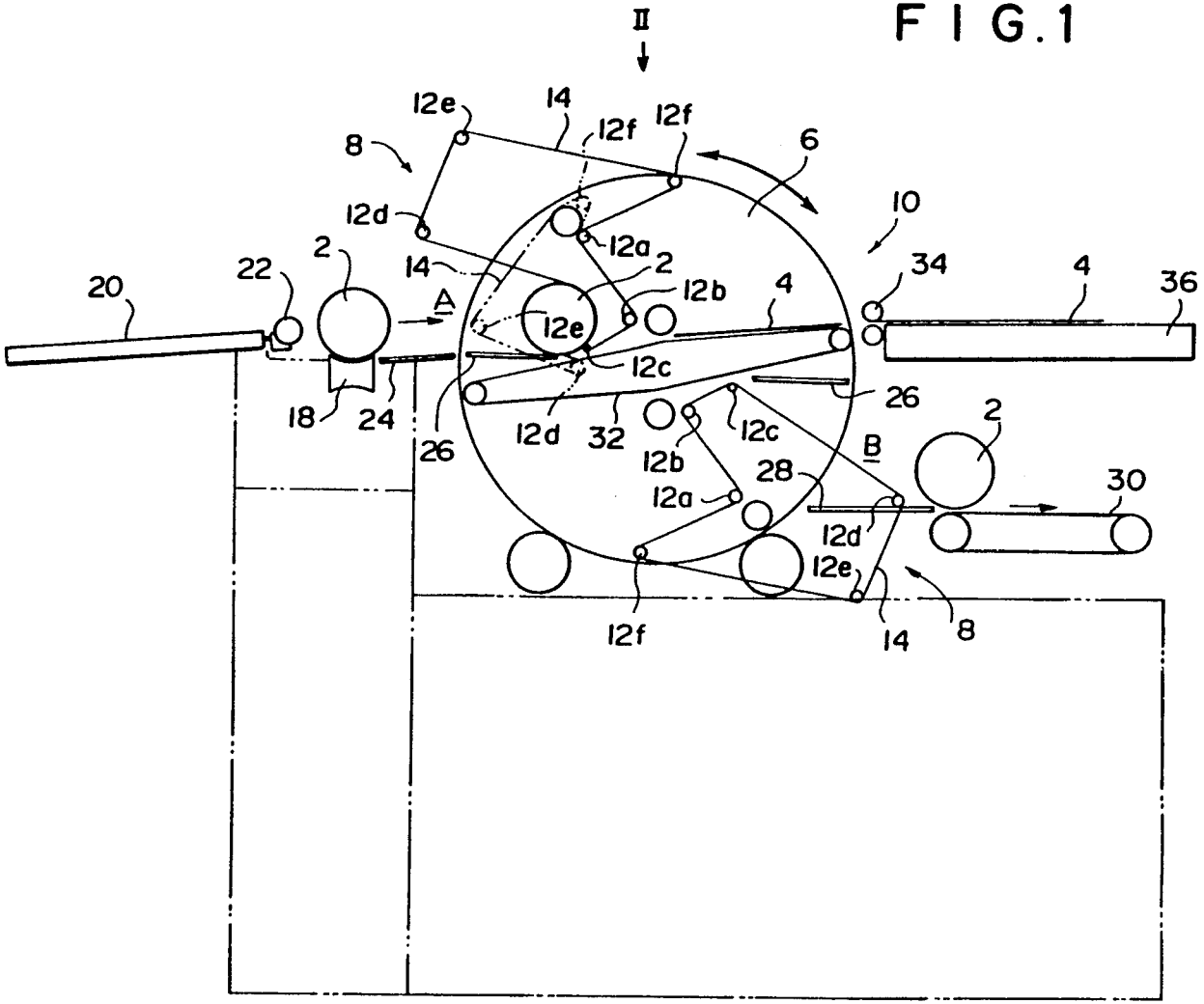
FIG. 1 is a side view showing a packaging system in accordance with an embodiment of the present invention.
Figure 2:
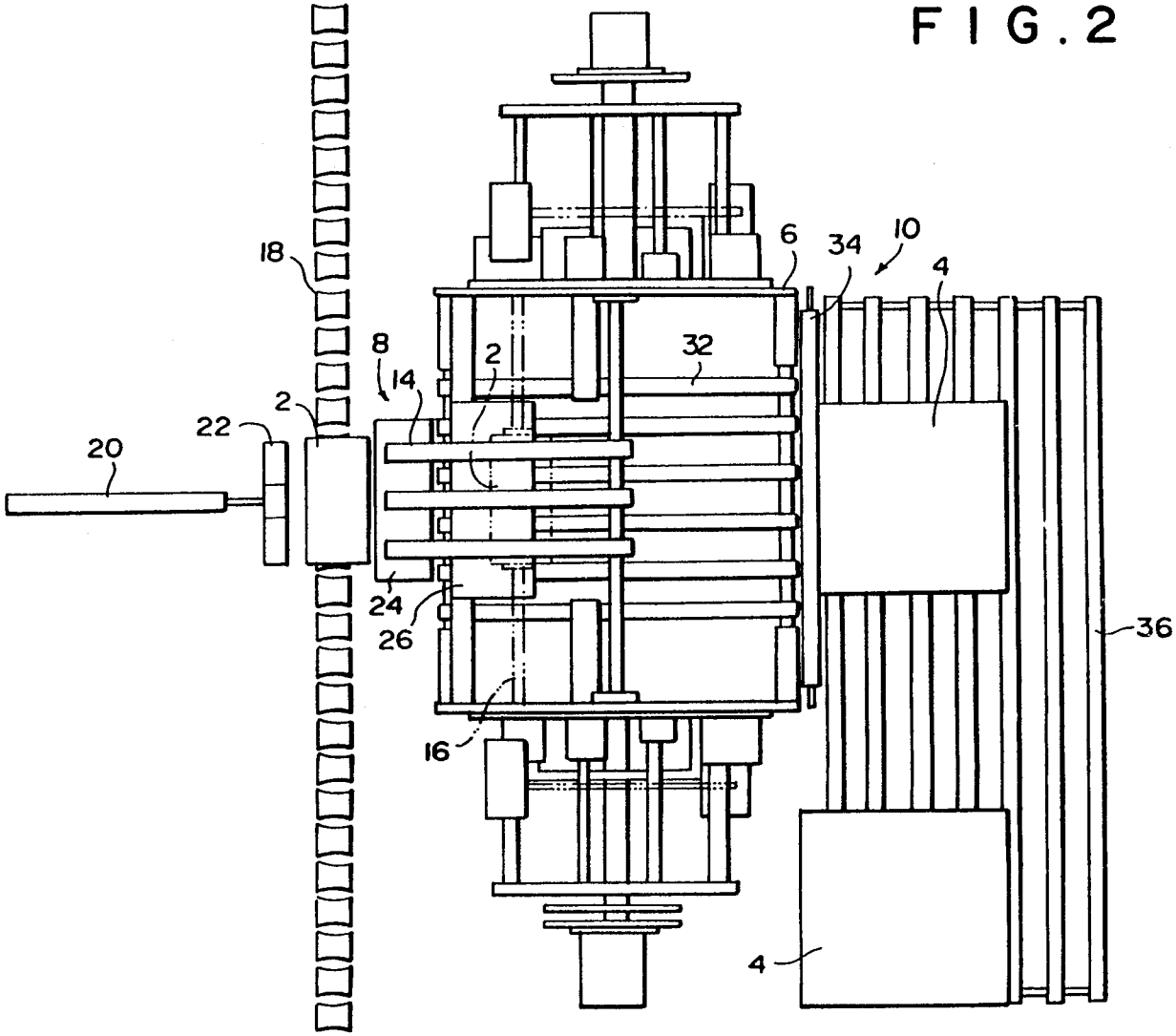
FIG. 2 is a view as seen in the direction of arrow II in FIG. 1.

In FIGS. 1 and 2, a packaging system in accordance with an embodiment of the present invention wraps a sheet material 4 around a cylindrical article 2 supplied at an article supply station A and discharges the article 2 at an article discharge station B. The packaging system includes a turret 6 which is intermittently rotated by 180°, and a pair of body wrapping mechanisms 8 which are provided on the turret 6 at an interval of 180° so that they are alternately positioned at the article supply station A and the article discharge station B when the turret 6 is stopped. Each body wrapping mechanism 8 wraps the sheet material 4 around the article 2 while the body wrapping mechanism 8 is rotated from the article supply station A to the article discharge station B. A sheet supply mechanism 10 supplies the sheet material 4 to a predetermined position on the turret 6 where the sheet material 4 can be supplied to the body wrapping mechanism 8 while the turret 6 is stopped.

The turret 6 is alternately rotated in one direction and the other. This is advantageous in that no slip ring, rotary joint or the like is needed in the power supply system for driving the turret, and accordingly troubles due to wear, poor contact or the like can be prevented and the system can be simplified.

Each body wrapping mechanism 8 comprises six pulleys 12*a* to 12*f*, endless wrapper belts 14 passed around the pulleys 12*a* to 12*f*, and a core chuck 16 which holds the article 2 at opposite ends. The pulleys 12*a*, 12*b* and 12*c* are stationary with respect to the turret 6 and the other pulleys 12*d*, 12*e* and 12*f* are rotatable relative to the turret 6. The pulley 12*f* imparts tension to the wrapper belts 14. When the turret 6 is stopped and the body wrapping mechanism 8 is positioned at the article supply station A, the pulleys 12*d*, 12*e* and 12*f* are rotated relative to the turret 6 and wrap the wrapper belts 14 around the article 2 as shown by the chained line in FIG. 1. Immediately thereafter, the core chuck 16 holds the article 2 as shown by the chained line in FIG. 2, and then the core chuck 16 is driven to revolve the article 2. On the other hand, when the body wrapping mechanism 8 is positioned at the article discharge station B, the core chuck 16 releases the article 2 and the wrapper belts 14 unwrap from the article 2. Then the article 2 is discharged.

The article 2 is fed near the article supply station A by supply rollers 18, and then pushed along guide plates 24 and 26 by a pusher 22 until it abuts against the puller 12*c*. The pusher 22 is driven by an air cylinder 20, the guide plate 24 is provided near the turret 6 and the guide plate 26 is fixed to the turret 6. At the article discharge station B, the article 2 wrapped with the sheet material 4 is transferred to a discharge conveyor 30 and is sent to the next step (the end folding step) by the discharge conveyor 30.

The sheet supply mechanism 10 comprises a sheet supply conveyor 32 which extends on the turret 6 along a diameter thereof, a pair of nip rolls 34 which are provided on a level with the end of the sheet supply conveyor 32 which is positioned remote from the article supply station A when the turret 6 is stopped, and an external conveyor 36 which conveys the sheet material 4 to the position in which the leading end of the sheet material 4 can be held by the nip rolls 34. Adhesive has been applied to the trailing end portion of the sheet material 4. When the turret 6 is stopped, the sheet supply conveyor 32 and the nip rolls 34 are operated and transfer the sheet material 4 from the external conveyor 36 to the sheet supply conveyor 32. The conveyors 32 and 36 are respectively provided with suction means (not shown) and the sheet material 4 is held on the conveyors. The nip rolls 34 releases the sheet material 4 after they conveys about half the sheet material 4, thereby preventing the adhesive on the trailing end portion from adhering to the nip rolls 34. The sheet supply conveyor 32 is disposed so that the upper surface of the end portion which is opposed to the article supply station A crosses the wrapper belts 14 when they are wrapped around the article 2.

The operation of the packaging system of this embodiment will be described hereinbelow.

When the turret 6 is stopped in the position shown in FIG. 1, the article 2 is supplied at the article supply station A and at the same time, the sheet material 4 is supplied to the sheet supply conveyor 32 by the sheet supply mechanism 10. Then the wrapper belts 14 are wrapped around the article 2, the article 2 is held by the core chuck 16 and the sheet material 4 is positioned in a predetermined position on the sheet supply conveyor 32. Thereafter, the turret 6 is rotated by 180°. The article 2 begins to be revolved as soon as the wrapper belts 14 are wrapped around the article 2 and the article 2 is held by the core chuck 16, and the sheet supply conveyor 32 continues to operate even after the sheet material 4 is positioned in the predetermined position. Accordingly, the sheet material 4 is inserted between the wrapper belts 14 and the article 2 immediately before the turret 6 begins to be rotated or while the turret 6 is rotated, and as the article 2 is revolved, the sheet material 4 is wrapped around the body of the article 2. This body wrapping operation is completed while the turret 6 is rotated by 180° (i.e., while the body wrapping mechanism 8 is rotated from the article supply station A to the article discharge station B), and as soon as the turret 6 is stopped, the wrapper belt 14 unwraps from the article 2 and the core chuck 16 releases the article 2 at the article discharge station B. Then the article 2 wrapped with the sheet material 4 is discharged. Simultaneously with the discharge of the article 2, another article 2 is supplied at the article supply station A and another sheet material 4 is supplied. Then the turret 6 is reversed by 180° and the aforesaid operation is repeated. In order to prevent the wrapper belts 14 from interfering with the members around the turret 6 while the turret 6 is rotated, the wrapper belts 14 are folded toward the center of the turret 6 after the article 2 is discharged.

As can be understood from the description above, in this embodiment, the sheet material 4 is supplied to a predetermined position on the turret 6 by the sheet supply mechanism 10 while the turret 6 is stopped, and the sheet material 4 is supplied to the body wrapping mechanism 8 and is wrapped around the body of the article 2 while the body wrapping mechanism 8 is rotated from the article supply station A to the article discharge station B. Accordingly, the turret 6 need not be stopped to perform the body wrapping operation, and thus the cycle time of the intermittent rotation of the turret 6 can be shortened, whereby the tact time can be shortened. Further, since the station for the body wrapping operation can be eliminated, the packaging system can be miniaturized.

Preferably, the packaging system of this embodiment is employed to wrap the sheet material of craft paper, laminated paper, polyethylene sheet or the like around an article which is about 40 to 140mm in diameter and about 210 to 270mm in length. In this case, the tact time time can be shortened to about 5 seconds which is about $\frac{2}{3}$ of the tact time in the conventional packaging system.

What is claimed is:

1. A packaging system which wraps a sheet material around an article supplied at an article supply station and discharges the article at a discharge station, the packaging system comprising a turret, means for rotating said turret by 180° a pair of article wrapping means provided on the turret at an interval of 180° from each other, each of said article wrapping means for wrapping sheet material around an article while the article wrapping means is rotated from the article supply station to the article discharge station, wherein each article wrapping means is alternately positioned at the article supply station and the article discharge station when the turret is stopped, a sheet supply means for supplying the sheet material to each of said article wrapping means including, a supply conveyor mounted on the turret to be rotated therewith, which extends at least partially along a diameter of the turret, said supply conveyor arranged to accept sheet material and deliver the sheet material to an article wrapping means, wherein said turret may begin rotating before the supply conveyor has delivered the sheet to the wrapping means without interrupting delivery of the sheet.

2. A packaging system as defined in claim 1 in which said rotating means rotates the turret 180° in one direction and then 180° in the opposite direction.

3. A packaging system which wraps a sheet material around an article supplied at an article supply station and discharges the article at a discharge station, the packaging system comprising a turret, means for rotating said turret by 180°, a pair of article wrapping means provided on the turret at an interval of 180° from each other, each of said article wrapping means for wrapping sheet material around an article while the article wrapping means rotates from the article supply station to the article discharge station, wherein each article wrapping means is alternately positioned at the article supply station and the article discharge station when the turret is stopped, a sheet supply means for supplying the sheet material to the article wrapping means including, supply conveyor means for accepting sheet material at one side of the turret and for delivering the sheet material to the article wrapping means at the opposite side of the turret, said supply conveyor means mounted on the turret such that said turret may begin rotating before the conveyor means has delivered the sheet to a wrapping means without interrupting delivery of the sheet.

4. A packaging system as defined in claim 3, in which said supply conveyor means carries the sheet material substantially near a center of the turret when delivering the sheet material to the article wrapping means.

* * * * *